US007864510B2

(12) United States Patent
Renzo

(10) Patent No.: US 7,864,510 B2
(45) Date of Patent: Jan. 4, 2011

(54) CLOTHES DRYER WITH WIRING SAFEGUARD

(75) Inventor: Pasquale Antonio Renzo, Anjou (CA)

(73) Assignee: Mabe Canada Inc., Burlington (CA)

( * ) Notice: Subject to any disclaimer, the term of this patent is extended or adjusted under 35 U.S.C. 154(b) by 313 days.

(21) Appl. No.: 12/232,212

(22) Filed: Sep. 12, 2008

(65) Prior Publication Data

US 2009/0260249 A1 Oct. 22, 2009

(30) Foreign Application Priority Data

Apr. 18, 2008 (CA) ..... 2629494

(51) Int. Cl.
*H05K 7/02* (2006.01)
*F26B 19/00* (2006.01)
*A47B 97/00* (2006.01)
*A47B 81/00* (2006.01)

(52) U.S. Cl. ..... 361/679.01; 361/104; 337/186; 337/187; 337/227; 312/223.6

(58) Field of Classification Search ..... 337/186, 337/187, 227; 312/223.6; 361/104, 679.01; D32/8

See application file for complete search history.

(56) References Cited

U.S. PATENT DOCUMENTS 2,790,247 A * 4/1957 Olthuis ..... 34/549
2,903,799 A * 9/1959 Sachaczenski ..... 34/527
3,054,194 A * 9/1962 Hayes ..... 34/665
4,422,247 A * 12/1983 Deschaaf ..... 34/550
4,663,861 A 5/1987 Scriber
4,827,627 A 5/1989 Cardoso
5,006,778 A * 4/1991 Bashark ..... 318/799
5,101,575 A 4/1992 Bashark
5,166,592 A 11/1992 Bashark
5,187,879 A * 2/1993 Holst ..... 34/261
5,315,765 A 5/1994 Holst et al.
6,047,486 A * 4/2000 Reck et al. ..... 34/491
6,370,798 B1 4/2002 Gonzalez, Jr.
6,519,871 B2 * 2/2003 Gardner et al. ..... 34/497
6,655,047 B2 12/2003 Miller, II
6,671,997 B2 1/2004 Beaumont
6,784,673 B2 * 8/2004 Tomasi et al. ..... 324/664
7,117,613 B2 10/2006 Guinibert
7,213,349 B1 5/2007 Brunner
7,225,562 B2 6/2007 Guinibert
7,257,905 B2 8/2007 Guinibert
7,301,127 B1 * 11/2007 Derridinger, Jr. ..... 219/386
7,478,486 B2 * 1/2009 Wunderlin et al. ..... 34/491
2005/0120586 A1 6/2005 Hwang
2005/0183284 A1 8/2005 Hwang
2008/0284558 A1 * 11/2008 Scheiber et al. ..... 337/401
2008/0285253 A1 * 11/2008 Scheiber et al. ..... 361/837

FOREIGN PATENT DOCUMENTS

JP 2005137504 A * 6/2005

* cited by examiner

*Primary Examiner*—Anatoly Vortman

(57) ABSTRACT

A clothes dryer cabinet has a rear wall with a wire entry opening through which wiring enters into the dryer cabinet. A fuse supporting block is mounted closely adjacent to the wire entry opening and supports fuses which are connected directly to the wiring entering through the wire opening so as to limit or minimize the length of wiring contained in the dryer drum that is not protected by the fuses. This safety feature reduces the chance of fires occurring in the dryer as a result of arcing between wires due to mishandling of the wires, malmanufacturing of the wires or a fire occurring in the dryer.

9 Claims, 5 Drawing Sheets

CLOTHES DRYER WITH WIRING SAFEGUARD

FIELD OF THE INVENTION

The present invention relates to a clothes dryer and, more particularly, to the placement of fuses in the clothes dryer cabinet to reduce the risk of fire occurring in the dryer cabinet or outside the cabinet due to shorting of the live wire lines in the dryer cabinet with one another, with the dryer cabinet, or with components inside the dryer cabinet.

BACKGROUND OF THE INVENTION

In domestic clothes dryers there has been a concern with respect to the build up of lint in the dryer or the ducting exiting the dryer, which build up of lint may result in the possibility of a fire in the dryer. As lint builds up in the dryer it creates a restriction on the airflow through the dryer. U.S. Pat. No. 6,671,977 issued to Beaumount discloses a safety system located outside of the dryer that measures the airflow in the exhaust vent and disconnects power to the household dryer female plug receptacle in the event that the airflow drops below a predetermined value.

U.S. Pat. No. 6,655,047 issued to Miller, II discloses a fire arrester for use with a clothes dryer that has a fire detector in a dryer vent externally of the dryer that detects fires starting in the dryer and disconnects electricity to the dryer while at the same time releasing an extinguishing agent into the dryer to suppress a fire. Neither of these two U.S. patents teaches the use of fuses in the dryer to disconnect power to the dryer.

U.S. Pat. No. 5,315,765 issued to Holst discloses a circuitry for a high efficiency microwave dryer wherein the live wire lines each has a fuse connected in circuit therewith. A third fuse is connected in circuit with a DC power supply. This patent teaches these fuses being current limiting fuses. There is no teaching of the physical location of these fuses in the dryer cabinet. U.S. Pat. No. 4,663,861 also discloses a fuse in dryer circuitry for disconnecting power to the dryer control circuit. There is no teaching in this patent of the physical location of the fuses in the dryer cabinet. Further, neither of these two US patents discloses the purpose of these fuses other than to be current limiting fuses.

As a result of testing done on domestic clothes dryers, it has been determined that electrical arcing between wires in the cabinet of the dryer can cause fire on the wire coatings of the wire, can spread fire to other areas in the dryer or ignite a cheese cloth draped over the dryer cabinet where the cheese cloth represents clothing left on top of the dryer by a user. Testing has shown that this arcing has caused cheese cloth, representing dust or lint trapped in the dryer or other items placed on or beside the dryer, to catch fire. The mere use of fuses in the wiring circuitry of the power lines may not be sufficient to reduce the risk of fire due to arcing between live wires. Further, the use of power disconnect devices other than fuses may be too slow or not sufficiently sensitive to disconnect power from the dryer when initial arcing occurs between wires. Also, power disconnect devices may not protect against arcing due to fires being random and the power disconnect device not reacting to potential causes of the fire resulting in a fire being produced in the dryer cabinet or on the outside of the cabinet. Consequently there is a need in domestic clothes dryers to provide for power disconnection to the dryer electrical load in the cabinet such that the wiring in the cabinet is a reduced safety hazard.

BRIEF DESCRIPTION OF THE INVENTION

The present invention relates to a clothes dryer and, more particularly, to the placement of fuses in the clothes dryer cabinet to reduce the risk of fire occurring in the dryer cabinet, or outside the dryer cabinet, due to shorting of the live wire lines themselves in the dryer cabinet, with the cabinet, or components inside the cabinet. The placement of the fuses closely adjacent to the opening where the wiring enters the clothes dryers allows the fuses to be wired into the circuit in series with each of the live power lines and thereby limit or minimize the length or amount of wiring in the dryer cabinet that is not protected by the fuse. Hence the risk is diminished of a fire starting due to arcing between wires, between the wires and components in the cabinet, or between the wires and the cabinet as a result of mishandling of the wiring, malmanufacturing of the wires, or due to fire that melts or burns wire insulation and causes electrical shorting that may ignite clothing that drapes the dryer cabinet.

It is important to disconnect power to the clothes dryer circuitry in the event of a fire in the base of the cabinet or in the drum of the dryer thus preventing any further shorting of the wires so as to diminishes the chances of a fire spreading outside of the dryer cabinet. Hence it is advantageous to have as much wire protected as possible in the cabinet by the fuses as this reduces the risk of any fire initiating in the dryer cabinet as a result of the wiring in the cabinet arcing.

In accordance with one embodiment of the present invention, there is provided a clothes dryer having an electrical load, comprising a cabinet having a wall. A power cord is electrically connected to the wall of the cabinet. The power cord has a neutral wire line and at least one entry live wire line. The neutral line is connected in electrical circuit with the electrical load. The wall has a wiring entry opening through which the neutral wire line and the at least one entry live wire line pass into, and extend within, the cabinet. The electrical load is further connected in electrical circuit with at least one load live wire line extending within the cabinet. A fuse for each entry live wire line is connected in electrical circuit between a corresponding entry live wire line and a corresponding load live wire line for disconnecting power to the load live wire line and the electrical load. The fuse is located inside the cabinet closely adjacent to the wiring entry opening so as to limit length of the at least one entry live wire line within the cabinet.

In accordance with another embodiment of the invention there is provided a clothes dryer having an electrical load, comprising a cabinet having a wall. A power cord is electrically connected to a terminal block mounted on the wall outside of the cabinet. The power cord has a cord neutral wire line and two cord live wire lines respectively connected at the terminal block to a dryer neutral wire line and corresponding ones of two dryer entry live wire lines. The electrical load is connected in electrical circuit with the dryer neutral wire line and two load live wire lines extending only within the cabinet. The wall has a wiring entry opening through which the dryer neutral wire line and the two dryer entry live wire lines pass into the cabinet from the block. Two fuses are each connected in electrical circuit between a corresponding one of the dryer entry live wire lines and a corresponding one of the load live wire lines for disconnecting power to the corresponding one load live wire line and the electrical load. The fuses are located inside the cabinet closely adjacent to the wiring entry opening so as to limit length of the dryer entry live wire lines within the cabinet.

BRIEF DESCRIPTION OF THE DRAWINGS

For a more thorough understanding of the nature and objects of the present invention reference may be had, by way of example, to the accompanying diagrammatic drawings in which.

DETAILED DESCRIPTION OF THE INVENTION

The present invention relates to a clothes dryer and in particular to the placement of fuses in the clothes dryer cabinet to reduce the risk of fire occurring in the dryer cabinet due to shorting of the live wire lines in the dryer cabinet.

Figure 1:
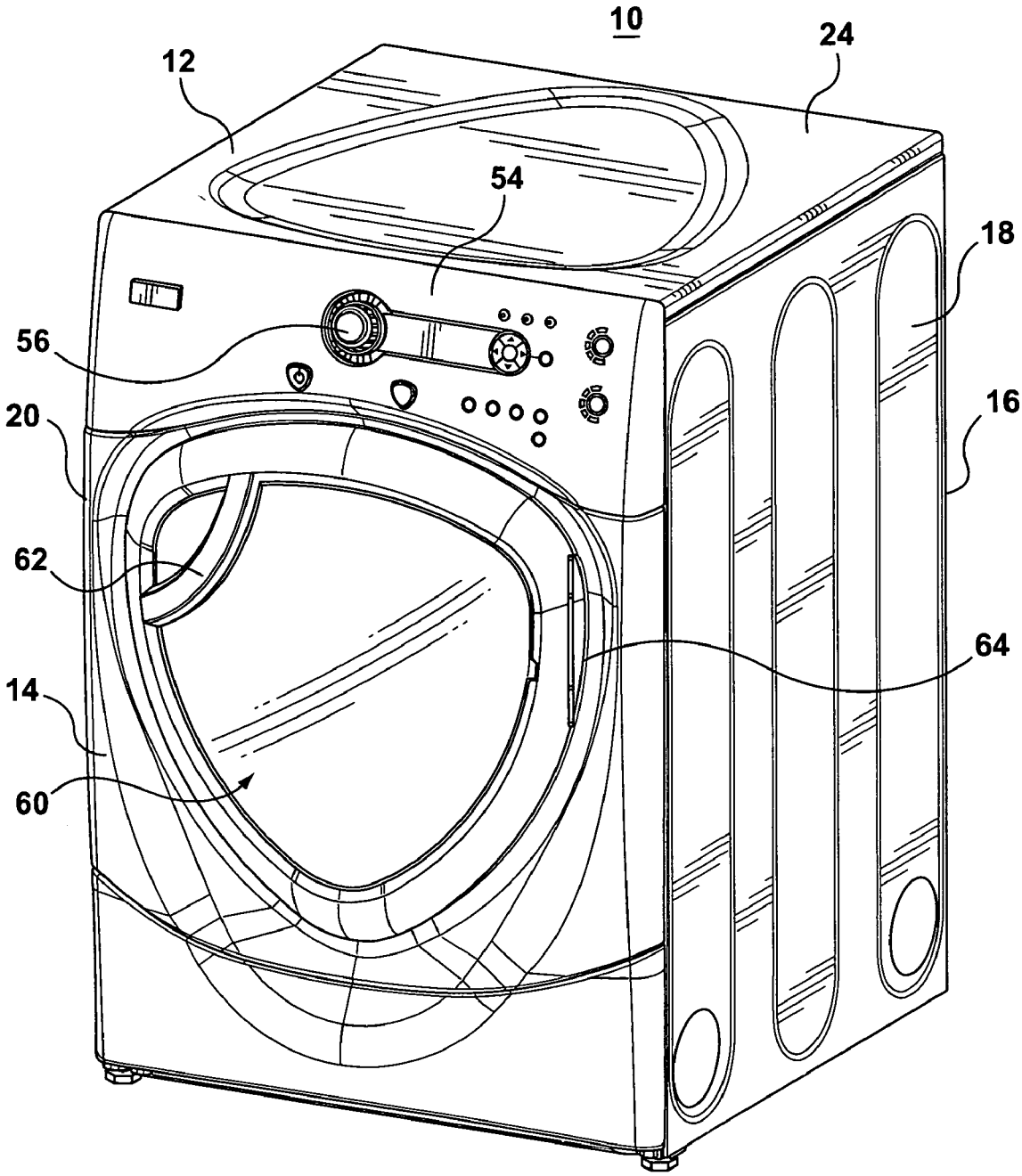
FIG. 1 is a perspective view of an exemplary clothes dryer that may benefit from the present invention.
Figure 2:
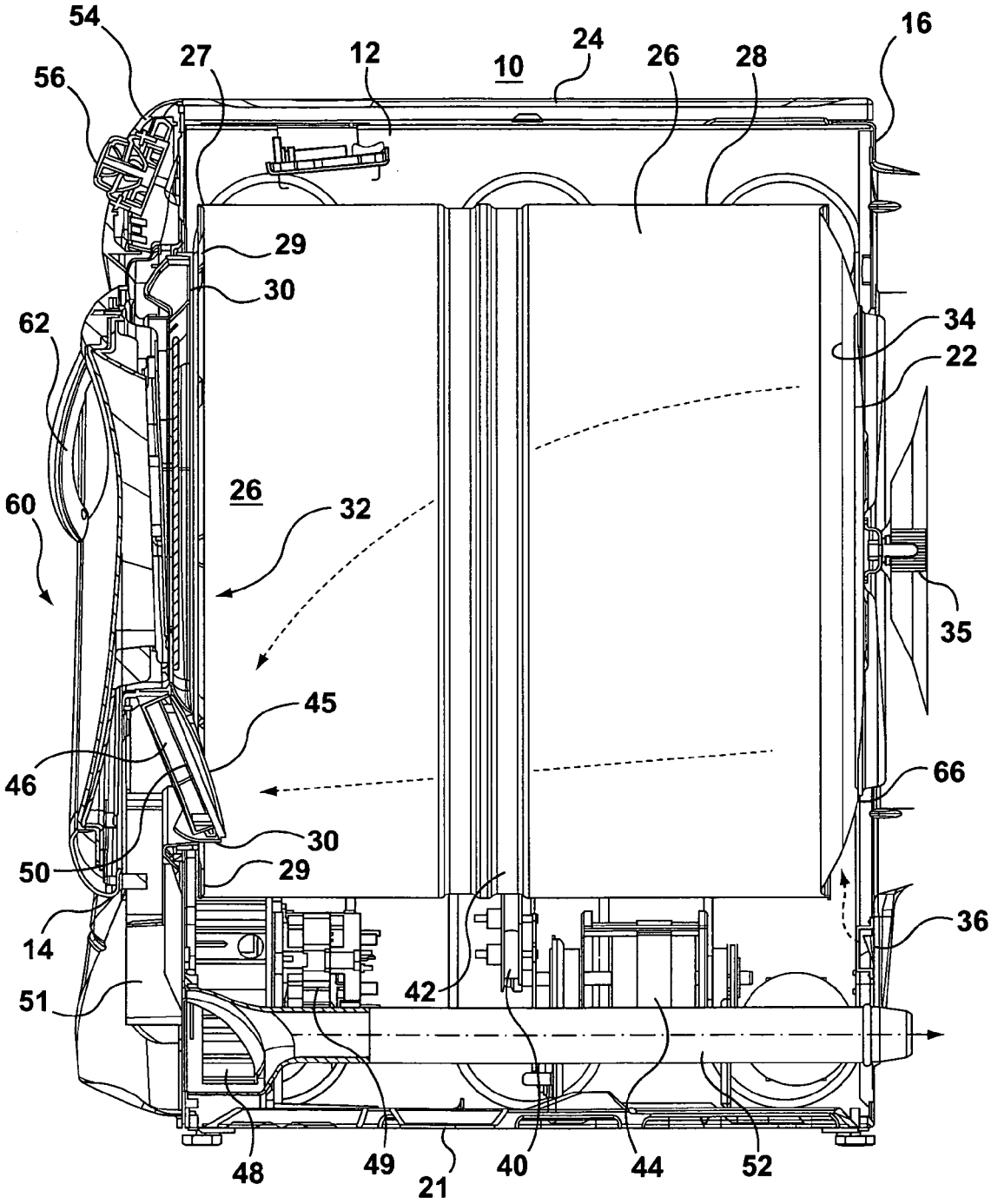
FIG. 2 is a side sectional view of an exemplary clothes dryer that may benefit from the present invention.
Figure 3:
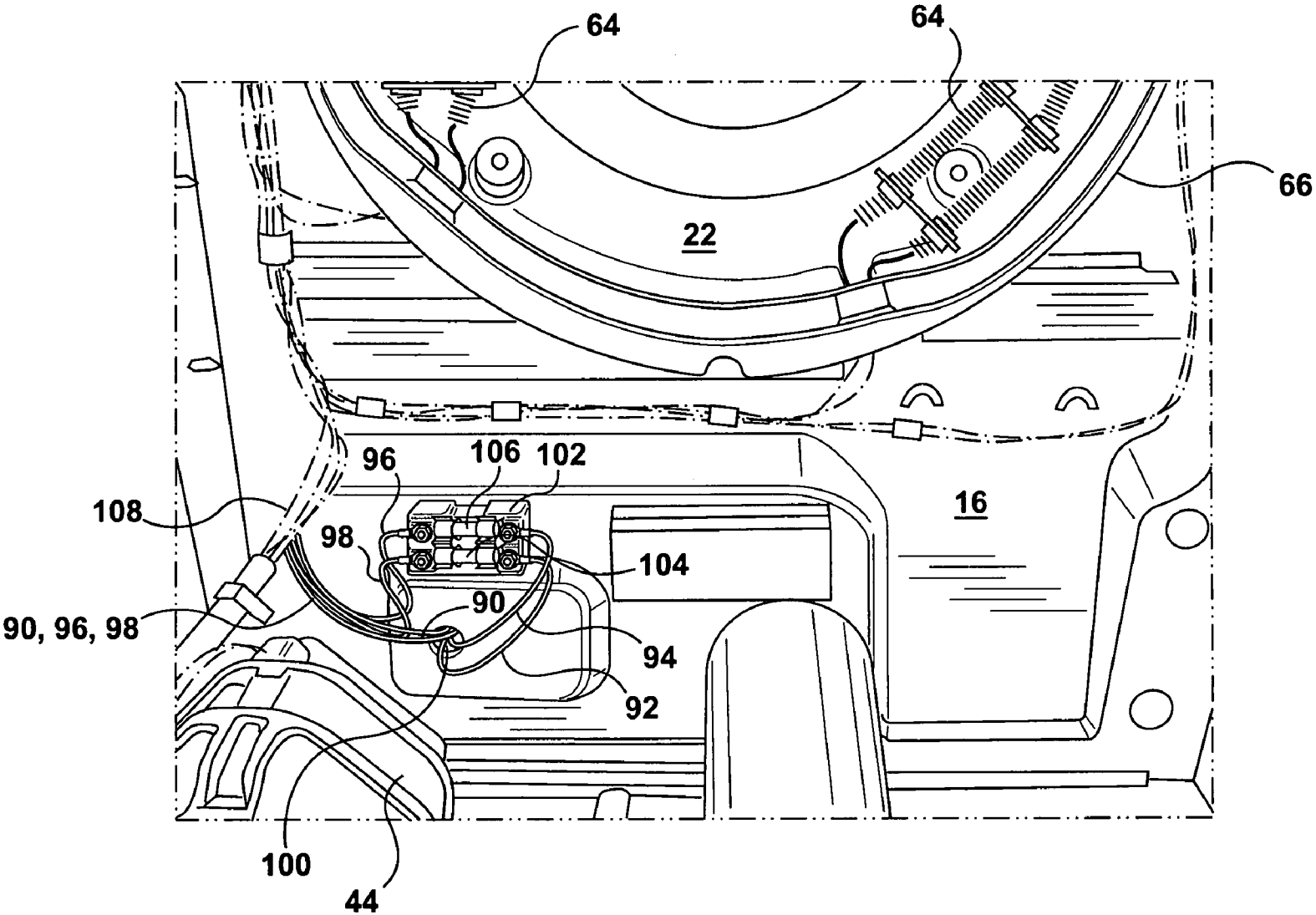
FIG. 3 is an interior perspective of the exemplary clothes dryer showing the rear wall of the clothes dryer cabinet with the rotating drum removed.

Referring to FIGS. 1 to 3, an exemplary clothes dryer 10 that may benefit from the present invention is shown. The clothes dryer 10 includes a cabinet or a main housing 12 having a front wall 14, a rear wall 16, a pair of side walls 18 and 20 spaced apart from each other by the front and rear walls, a floor 21 and a top cover 24.

Within the housing 12 is a drum or container 26 mounted for rotation around a substantially horizontal axis. A motor 44 rotates the drum 26 about the horizontal axis through, for example, a pulley 40 and a belt 42. The drum 26 is generally cylindrical in shape, has an outer cylindrical wall 28, and has an open end 27 that typically comprises a metal ring 29 attached by welding to the drum 26 for reducing the diameter of the opening of the drum 26 to match a front bulkhead wall or front bearing 30. The bearing 30 further defines an opening 32 into the drum 26. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates.

The drum 26 includes a drum rear wall 34 rotatably supported within the main housing 12 by bearing 35. The drum rear wall 34 includes a plurality of holes (not shown) that receive hot air that has been heated by a heater comprising electrical heating elements 64 located in heater housing 22. The heater housing 22 receives ambient air passing through an inlet or louvres 36 and into the heater housing around circular flange 66 of the heater housing 22.

Although the exemplary clothes dryer 10 shown in FIG. 1 is an electric dryer having electrical heating elements 64 that warm the ambient air, it should be understood that the dryer may be a gas dryer having a gas burner for heating ambient air entering the dryer. The gas burner may be located below the drum 26 and have ducting extending from the gas burner up to the drum rear wall 34.

Air heated by the heater is drawn into and from the drum 26 by a blower fan 48 which is also driven by a second motor 49 in the embodiment shown. In an alternative embodiment, motor 44 may be used to drive blower fan 48. Air is drawn by the blower fan 48 from the heater housing 22, into, through and out of the drum 26, through a grill 45 and screen filter 46. Grill 45 keeps clothing articles tumbling in the drum 26 from contacting the filter 46 and touching the lint trapped by the filter 46 within the trap duct 50. As the air passes through the screen filter 46, it flows through lower duct portion 51 and is blown by blower wheel 48 attached to motor 49 out of the clothes dryer 10 through an exhaust duct 52. In this embodiment, the drum 26 is in air flow communication with the trap duct 50 whose lower duct portion 51 has an outlet that is in air flow communication with the blower wheel 48 and the exhaust duct 52. The exhaust duct 52 passes through the rear panel 16 and is usually connected to suitable venting (not shown) that vents the air outdoors.

After the clothing articles have been dried, they may be removed from the drum 26 via the opening 32. Opening 32 is shown closed by a window or port-hole like door 60. Door 60 has a handle 62 for pivotally opening the door about hinge 64.

The dryer 10 is shown to have a control panel 54 with touch and or dial controls 56 that permit the user to control operation of dryer 10.

Figure 4:
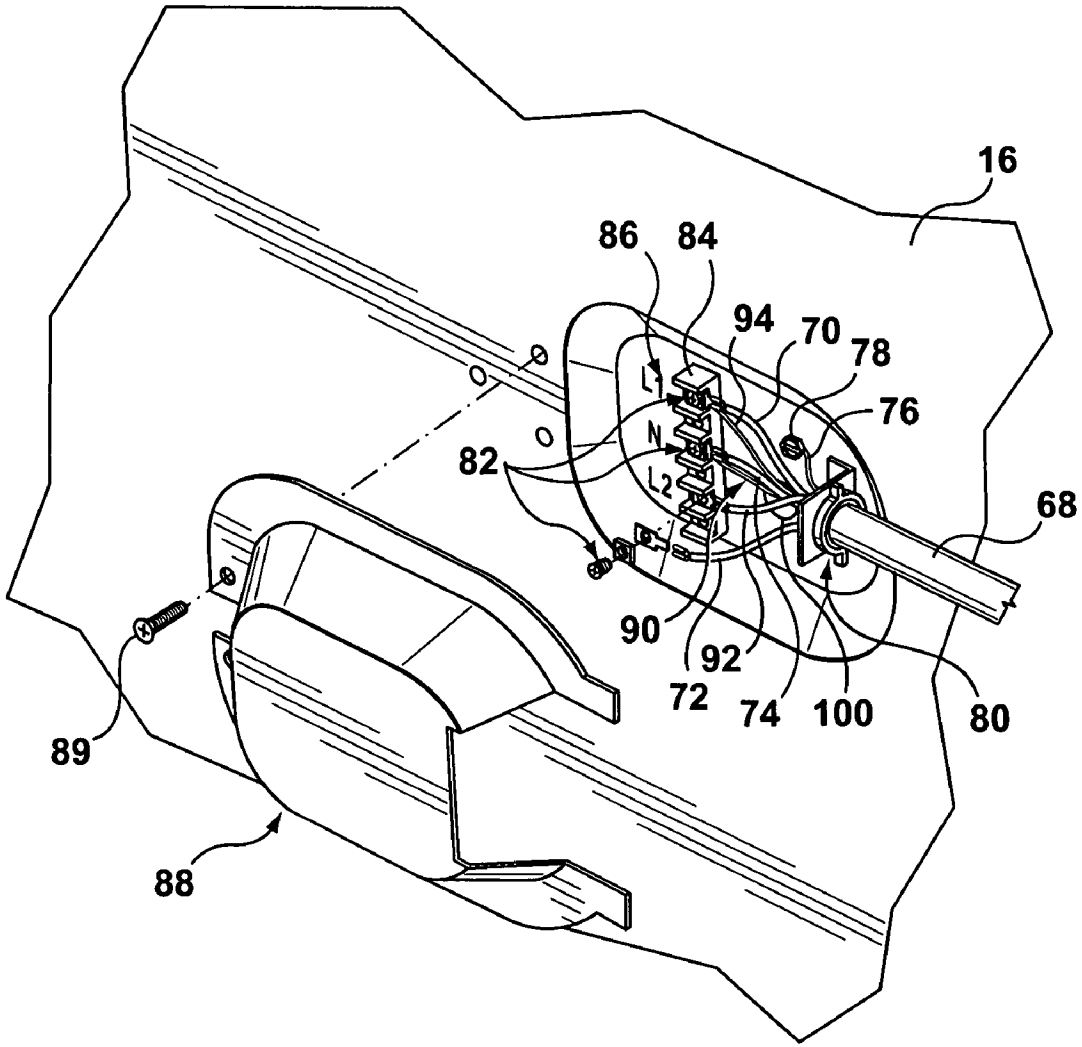
FIG. 4 is a partial exterior view of the rear wall showing the connection of the power cord to an exemplary terminal block for an exemplary electric clothes dryer.
Figure 5:
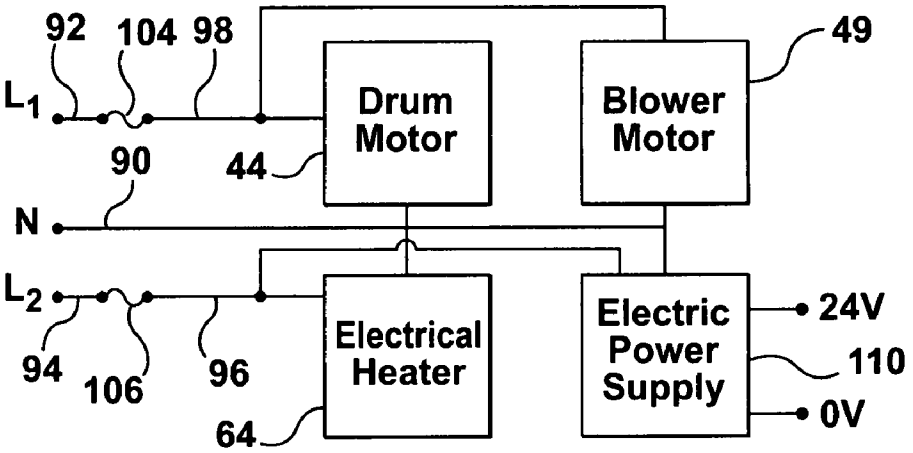
FIG. 5 is an electrical schematic diagram for an exemplary clothes dryer heated by one or more electrical heating elements; and, FIG. 6 is an electrical schematic diagram for and exemplary clothes dryer heated by a gas heater.

Referring to FIGS. 3, 4 and 5 the wiring circuitry for clothes dryer 10 is shown. Power is supplied to the dryer in FIG. 4 through a power cord 68, the power cord 68 has two live power wire lines 70 and 72, a neutral wire line 74 and a ground wire 76. Ground wire 76 is shown connected by screw 78 to the rear wall 16 of the clothes dryer. The wire lines 70, 72, 74 and 76 of the power cord 68 are rated for 120/240 volts and 30 amps. The power cord 68 is connected to the dryer rear wall 16 through a strain relief bracket 80. The live wire lines 70 and 72 as well as the neutral wire line 74 are connected by screws 82 to separate connection terminals in terminal block 84 of the terminal block assembly 86. A cover 88 is fastened by screw 89 to the rear wall 16 to cover the terminal block assembly 86. The terminal block 84 is shown mounted to the outside of the rear wall 16.

Referring to FIGS. 3 and 4, a dryer neutral wire line 90 and two cabinet live wire lines 92 and 94 pass through a wiring entry opening 100 located in the rear panel 16 of the dryer 10. Wires 90, 92 and 94 are shown in FIG. 4 entering the dryer cabinet 12 through the opening 100 and are shown in FIG. 3 emerging from the opening 100 into the interior of the dryer cabinet 12. The dryer entry live wires 92 and 94 are respectively connected through fuses 104 and 106 with respective load live wire lines 96 and 98. Load live wire lines 96 and 98 together with neutral line 90 are connected in wiring harness 108 to provide power to various loads within the clothes dryer cabinet including for example motor 44 and heating elements 64 of heater housing 22. It should be understood that the wiring harness 108 will also provide power to motor 42 and to a power supply (not shown) for the electronic components for the clothes dryer 10.

Referring to FIG. 5, the distribution of the power to the loads 44, 49, 64 and 110 in the dryer drum is shown. Power line L1 has fuse 104 between dryer load live wire line 98 and dryer entry wire line 92 to provide power to the drum motor 44 and the blower motor 49. Power from the second power line L2 is by dryer entry power live wire line 94, fuse 106, and load power live wire line 96 to the electrical heating element 64 and the electronic power supply 110. In the event of shorting or arcing caused by the wire lines 96, 98; fuses 106, 104 open or blow disconnecting the load wires from the power.

As can be seen in FIG. 3, the placement of the fuses 104 and 106 on the fuse terminal block or supporting block 102 is closely adjacent to the entry opening 100 for the wiring. This limits the length of the wires 92 and 94 to extend a considerably short distance within the dryer cabinet. As a result, this is the only portion of the live wires in the cabinet that may be considered to be unprotected by the fuses. Accordingly the other live wiring associated with live load wire lines 96 and 98 are protected by the fuses 104 and 106 blowing to disconnect power to the live load wiring 96 and/or 98 in the event of any arcing or deterioration in the wiring thereby reducing the risk of a potential fire in the dryer cabinet or outside the dryer cabinet.

The wiring circuitry shown in FIGS. 3 and 4 is for two power lines to the electric dryer and the fuses are each 30 amp fuses referred to as FLM fuses. A fuse suitable for the embodiment of the present invention of FIGS. 3 and 4 is a 30 amp fuse manufactured by LITTEL FUSE of Illinois, USA under part number L7L12F.

Figure 6:
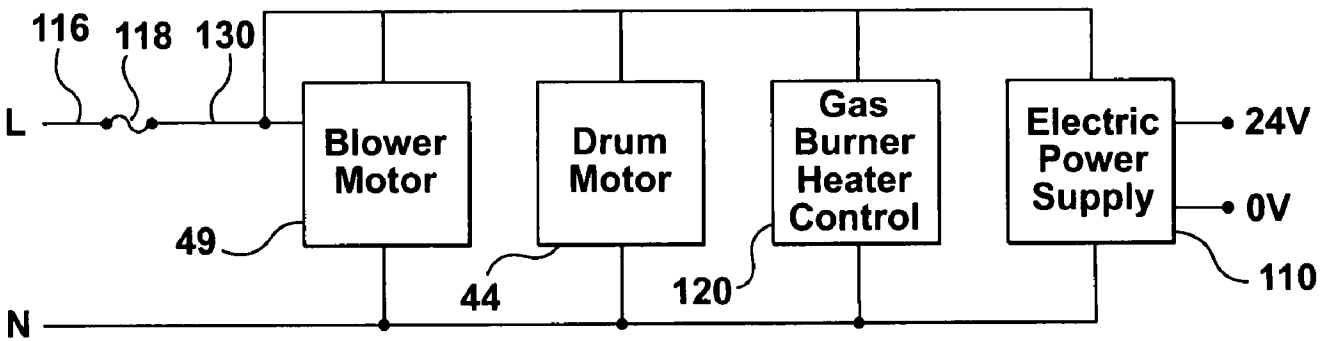

It should be understood that for a gas dryer, the amount of power to the dryer is reduced since the heating is achieved by combustion of natural gas or propane gas, and not by electrical heating elements. As a result, typically wiring for this arrangement comprises one power line and one neutral line entering into the dryer drum and rated at 120V and 15 Amps. A power cord connected to the dryer includes a power line, a neutral line and a grounding wire line. The grounding wire is grounded to the chassis or cabinet 12 of the clothes dryer 10. A block is used similar to that shown in FIG. 4, or alternatively, the power cord is connected directly through a strain relief bracket to the dryer so that the live wire line and the neutral wire line of the power cord pass directly through a wire entry opening into the clothes dryer cabinet. The fuse is located closely adjacent to the entry opening so as to minimize the length of unprotected live wire line of the power cord within the dryer cabinet. A schematic representation of the wiring diagram or such a system is shown in FIG. 6 wherein the entry live wire line 116 and the neutral wire line 114 are provided for supplying power to the blower motor 49, the drum motor 44, the gas burner 120, and the electronic power supply 110. Fuse 118 is located in the circuit to disconnect power to the load live wire line 130 and the load 49, 44, 120, and 110.

The fuse 118 is located closely adjacent to the entry opening through which the power lines entered into the dryer cabinet similar to the arrangement shown in FIG. 3, save for one fuse instead of two, so as to minimize the length of the live wire line within the cabinet that is not protected by the fuse 118. In this embodiment for a gas dryer, one 15 amp fuse may be used such as a CCMR fuse. Such a fuse is available by LITTEL FUSE under part number L8B22F.

While the invention has been described in terms of various specific embodiments, those skilled in the art will recognize that the invention can be practiced with modifications within the scope of the present invention as disclosed herein.

What is claimed is:

1. A clothes dryer having an electrical load, comprising:

a cabinet having a wall;

a power cord mounted on the wall outside of the cabinet, the power cord having a cord neutral wire line and at least one entry live wire line, the neutral line being connected in electrical circuit with the electrical load;

the wall having a wiring entry opening through which the neutral wire line and the at least one entry live wire line pass into, and extend within, the cabinet;

the electrical load being further connected in electrical circuit with at least one load live wire line extending within inside the cabinet; and, a fuse for each entry live wire line being connected in electrical circuit between a corresponding entry live wire line and a corresponding load live wire line for disconnecting power to the load live wire line and the electrical load, the fuse being located inside the cabinet closely adjacent to the wiring entry opening so as to limit length of the at least one entry live wire line within the cabinet.

2. The clothes dryer of claim 1 further comprising a fuse supporting block to which the fuse may be mounted, the fuse supporting block being mounted to an inside surface of the wall closely adjacent the wiring entry opening.

3. The clothes dryer of claim 2 wherein the electrical load comprises at least one motor, and an electronic power supply.

4. The clothes dryer of claim 1 wherein the wall comprises a rear wall of the cabinet.

5. A clothes dryer having an electrical load, comprising:

a cabinet having a wall;

a power cord electrically connected to a block mounted on the wall of the cabinet, one of the power cord and the block having a neutral wire line and at least one entry live wire line, the neutral line being connected in electrical circuit with the electrical load;

the wall having a wiring entry opening through which the neutral wire line and the at least one entry live wire line pass into, and extend within, the cabinet;

the electrical load being further connected in electrical circuit with at least one load live wire line extending within inside the cabinet; and, a fuse for each entry live wire line is connected in electrical circuit between a corresponding entry live wire line and a corresponding load live wire line for disconnecting power to the load live wire line and the electrical load, the fuse being located inside the cabinet closely adjacent to the wiring entry opening so as to limit length of the at least one entry live wire line within the cabinet.

6. A clothes dryer having an electrical load, comprising:

a cabinet having a wall;

a power cord electrically connected to a terminal block mounted on the wall outside of the cabinet, the power cord having a cord neutral wire line and two cord live wire lines respectively connected at the terminal block to a dryer neutral wire line and corresponding ones of two dryer entry live wire lines;

the electrical load being connected in electrical circuit with the dryer neutral wire line and two load live wire lines extending only within the cabinet;

the wall having a wiring entry opening through which the dryer neutral wire line and the two dryer entry live wire lines pass into the cabinet from the block; and, two fuses each being connected in electrical circuit between a corresponding one of the dryer entry live wire lines and a corresponding one of the load live wire lines for disconnecting power to the corresponding one load live wire line and the electrical load, the fuses being located inside the cabinet closely adjacent to the wiring entry opening so as to limit length of the dryer entry live wire lines within the cabinet.

7. The clothes dryer of claim 6 further comprising a fuse supporting block to which the fuses are mounted, the fuse supporting block being mounted to an inside surface of the wall closely adjacent the wiring entry opening.

8. The clothes dryer of claim 7 wherein the electrical load comprises at least one motor, at least one electrical heating element, and an electronic power supply.

9. The clothes dryer of claim 6 wherein the wall is a rear wall of the dryer.

* * * * *

UNITED STATES PATENT AND TRADEMARK OFFICE

CERTIFICATE OF CORRECTION

PATENT NO. : 7,864,510 B2
APPLICATION NO. : 12/232212
DATED : January 4, 2011
INVENTOR(S) : Pasquale Antonio Renzo It is certified that error appears in the above-identified patent and that said Letters Patent is hereby corrected as shown below:

IN THE SPECIFICATIONS:

Column 2,
Line 63, “the block” should be --the terminal block--;

Column 5,
Line 40, “A block” should be --A terminal block--;

IN THE CLAIMS:

Column 6,
Line 34, “a block” should be --a terminal block--;
Line 36, “block having” should be --terminal block having--;
Line 65, “the block” should be --the terminal block--.

Signed and Sealed this
First Day of March, 2011

David J. Kappos

David J. Kappos
*Director of the United States Patent and Trademark Office*